US006158495A

United States Patent [19]

Bigger

[11] Patent Number: 6,158,495

[45] Date of Patent: Dec. 12, 2000

[54] VENTING VALVE DEVICE FOR DIE CASTING

[75] Inventor: René Bigger, Brent, Switzerland

[73] Assignee: V.D.S. Vacuum Diecasting Service S.A., Brent, Switzerland

[21] Appl. No.: 09/220,852

[22] Filed: Dec. 28, 1998

[30] Foreign Application Priority Data

Feb. 11, 1998 [EP] European Pat. Off. ..... 98810107

[51] Int. Cl.[7] ..... B22D 17/22; B22D 17/32

[52] U.S. Cl. ..... 164/155.1; 164/155.3; 164/155.4; 164/155.6; 164/305; 164/410

[58] Field of Search ..... 164/305, 410, 164/155.1, 155.3, 155.4, 155.6

[56] References Cited

U.S. PATENT DOCUMENTS

| | | | |
|---|---|---|---|
| 4,239,080 | 12/1980 | Hodler | 164/305 |
| 4,463,793 | 8/1984 | Thurner | 164/305 X |
| 5,683,730 | 11/1997 | Katsumata et al. | 164/305 X |

FOREIGN PATENT DOCUMENTS

| | | | |
|---|---|---|---|
| 42 16 773 | 11/1993 | Germany . | |
| 39 12 006 | 6/1994 | Germany . | |
| 43 02 798 | 6/1994 | Germany . | |
| 63-256252 | 10/1988 | Japan | 164/305 |
| 64-27757 | 1/1989 | Japan | 164/305 |
| 3-161156 | 7/1991 | Japan | 164/305 |

*Primary Examiner*—J. Reed Batten, Jr.
*Attorney, Agent, or Firm*—Foley & Lardner

[57] ABSTRACT

In the venting valve device for die-casting, the evacuation valve which is intended to be closed comprises an evacuation piston and is actuatable by a pneumatic control piston which is in the form of a double-acting differential piston, whereby one of its pressure surfaces is supplied with compressed air by a high response valve in order to open while its other pressure surface is supplied with compressed air by a second control valve in order to close. The high response valve is provided with a vent in order to reduce the pressure maintaining the control piston in the open position within a very short time and thus to ensure a very short closing time of the evacuation piston. While being simple in construction, such a venting valve allows a very short closing time and is therefore particularly suitable also for high-speed die-casting.

10 Claims, 2 Drawing Sheets

VENTING VALVE DEVICE FOR DIE CASTING

FIELD OF THE INVENTION

The present invention refers to a valve device, particularly a venting valve device for die-casting, the device comprising an evacuation valve which closes a channel and whose closing movement is controlled by an electric control circuit.

BACKGROUND OF THE INVENTION

A number of venting valve devices for die-casting, e.g. according to German Patent No. 4 302 798, are actuated by the action of the metal, the device comprising a force transducer which is actuated by the cast material, and the transducer being mechanically connected to the movable shutter of the venting valve. Indeed, the attained shut-off speeds are very fast, thus allowing an application in high-speed die-casting as well. The disadvantage is that due to the necessary control stroke of the force transducer, liquid metal enters the guide bore of the latter at each injection stroke. This leads to an increased wear of the control piston and of its guide bore. These locations may also be subject to cold pickups which may block the control pistons. Even if this control function is only slightly impaired, the shutting action of the evacuation piston will be too slow, and the liquid metal will enter the venting valve, solidify, and block the entire installation. This leads to increased standstill and maintenance costs of the machine. Moreover, valve devices of this kind have many mechanical parts, and the opening force acting in the venting operation must be small in order not to counteract a fast shut-off time.

It has been attempted to eliminate the described drawbacks by closing the control member by an electric control circuit instead of its actuation by the cast material. German Publication No. 3 912 006 discloses a gas evacuation device in a high-speed die-casting installation where a gas evacuation valve is closed by a combination of a control circuit and a valve driving unit. This device, comprises a relatively complex control circuit, the proper control valves being pilot controlled by servo valves in order to attain short switching times. In the process, the actual control signals have to be amplified, converted, and adapted to the existing interfaces.

Finally, German Publication No. 4 216 773 discloses a die-casting installation whose releasing device comprises a metal sensor engaging in the casting path which is followed by a switching device, the valve being closed with a delay.

SUMMARY OF THE INVENTION

On the background of this prior art, it is the object of the present invention to provide a valve device which is also applicable as a venting valve device for high-speed die-casting and whose construction requires few components and is therefore economical, on one hand, and which allows very short closing times, on the other hand. This object is attained by a valve device wherein the evacuation valve to be closed comprises an evacuation piston and which is actuatable by a pneumatic control piston which is in the form of a double action differential piston, whereby one of its two pressure surfaces is supplied with compressed air by a high response valve in order to open while its other pressure surface is supplied with compressed air by a second control valve in order to close, said high response valve comprising a vent in order to reduce the pressure maintaining said control piston in the open position in a very short time.

BRIEF DESCRIPTION OF THE DRAWINGS

The invention will be explained in more detail hereinafter with reference to a drawing of an embodiment.

DETAILED DESCRIPTION OF THE INVENTION

As already mentioned in the introduction, it is an object of the present invention to improve a valve device in such a way that no mechanical influences may hinder a fast shut-off even in continuous operation. This means that the injection of liquid metal into the venting valve must be prevented. Furthermore, such a device should comprise a minimal number of components and provide distinct switching positions. The control should be simple and should not require servo valves, i.e. it should be triggered directly. The control signal for closing the venting valve should not require any amplification, conversion, or adaptation to possible interfaces, i.e. it should also be appropriate for a direct control. It is important that the actual closing procedure of the valve device is completed in only a few milliseconds, i.e. the closing speed of such a venting valve should not be inferior to the closing speed of a metal-actuated valve, or only unsubstantially.

The following description of an embodiment in the form of a venting valve device will show that the above list of requirements can be fulfilled entirely.

Figure 1:
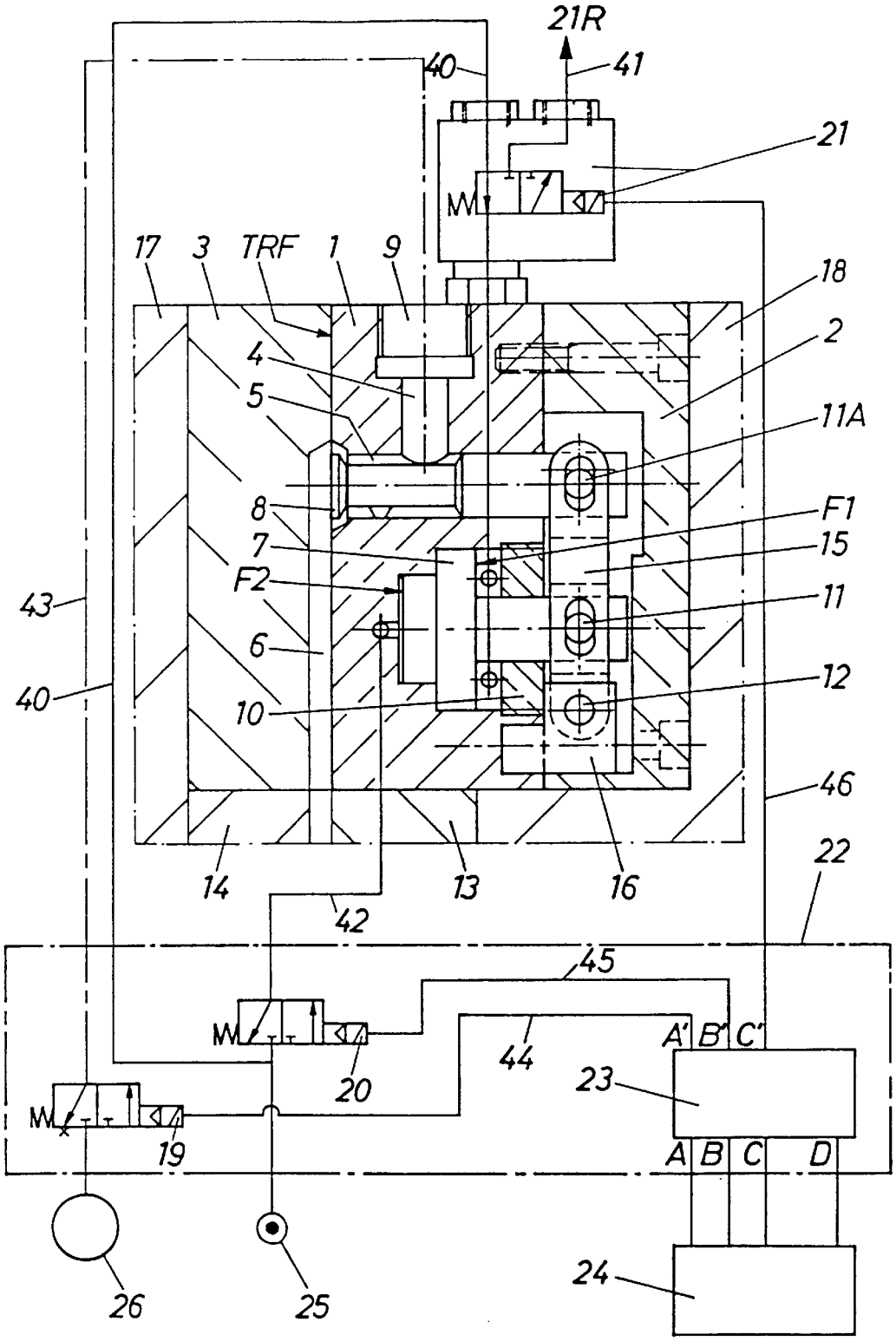
FIG. 1 shows the invention by way of a schematically illustrated venting valve device.

FIG. 1 illustrates the two valve blocks 1 and 2, venting channel plate 3 including first venting bore 5, second venting bore 4 and third venting bore 9, and venting channel 6, which is located between valve block 1 and venting channel plate 3. The mold joint of the die-casting mold between venting channel plate 3 and valve block 1 is designated by TRF.

The functional part of the venting valve device includes a control piston 7 which is connected by a first driving pin 11 to a lever 15, one end of which is hinged on a hinge pin 12 while its other end is connected by a second driving pin 11A to an evacuation piston 8 which is guided in first venting bore 5 in order to close it. Lever 15 and hinge pin 12 are supported in a bearing block 16 while control piston 7 is guided in valve block 1 and in a guide 10.

Further shown are mold insert 13 of the stationary mold half as well as mold insert 14 of the movable mold half and mold frame 18 of the stationary mold half and mold frame 17 of the movable mold half.

The closing movement of evacuation piston 8 is controlled by control piston 7 which is controlled by a directly controllable high response valve (HR valve) without additional electronic amplification. These valves have a particularly low mass and are especially heat resistant and effective while allowing extremely short switching times. HR valve 21 is connected to a pressure line 40 which is supplied by a pressure source 25, the output of the pressure line of this valve being connected to control piston 7 and acting upon the first pressure surface F1 in order to actuate the control piston, thus allowing to open evacuation piston 8. HR valve 21 comprises a vent 21R, the cross-sectional area of venting line 41 being at least twice as large as that of pressure line 42 and as short as possible in order to allow a very fast pressure reduction in the pressure line leading to the control piston. FIG. 1 further shows that HR valve 21 is directly mounted on the valve block.

Control piston 7 is furthermore connected by a second control valve 20 to a second pressure line 42 which is connectable to first pressure line 40 by second control valve 20. Pressure line 42 acts upon the second switching surface F2 in order to move control piston 7 in the closing direction and thereby to close evacuation piston 8.

Consequently, control piston 7 is a double-acting pneumatic cylinder, control piston 7 being instantly loaded in the closing direction at the beginning of the "evacuation" cycle by second control valve 20, i.e. both sides of the double-acting control piston are under pneumatic pressure before the actual control signal for closing the valve. Thus, in the controlled venting of the HR valve by venting line 41 and the resulting sudden pressure drop in pressure line 40 between the HR valve and pressure surface F1, the fastest possible reaction and switching time are obtained in order to perform the closing movement. Moreover, lever 15 acts as a multiplication in the closing movement of evacuation piston 8, thereby allowing to keep the control stroke of the control piston as small as possible. This results in the fastest possible control stroke of control piston 7, said stroke being effected in the shortest possible time in order to close evacuation piston 8.

Numeral 22 indicates the actual control circuit which, in addition to the above-mentioned second control valve 20, further includes vacuum valve 19, which is connected to vacuum source 26, as well as the so-called SPC control 23, SPC standing for Stored Program Control. In this example, SPC control 23 is connected to die-casting machine control 24, but it may as well be connected to an external auxiliary control system. In this SPC control, inputs A, B, C, D are illustrated which symbolize A=vacustart input, B=vacustop loading input, C= vacustop input for HR valve 21, and D= electric input voltage input, as well as outputs A', B', C' which symbolize A'=vacustart output, B'=vacustop loading output, and C'= vacustop output for HR valve 21.

Further illustrated is vacuum line 43 which connects vacuum source 26 to venting bores 4, 5, and 9. In addition, the different electric lines 44 between output A' and vacuum valve 19, line 45 between the vacustop loading output and second control valve 20, and line 46 between the vacustop output for HR valve 21 and HR valve 21 are shown.

Figure 2:
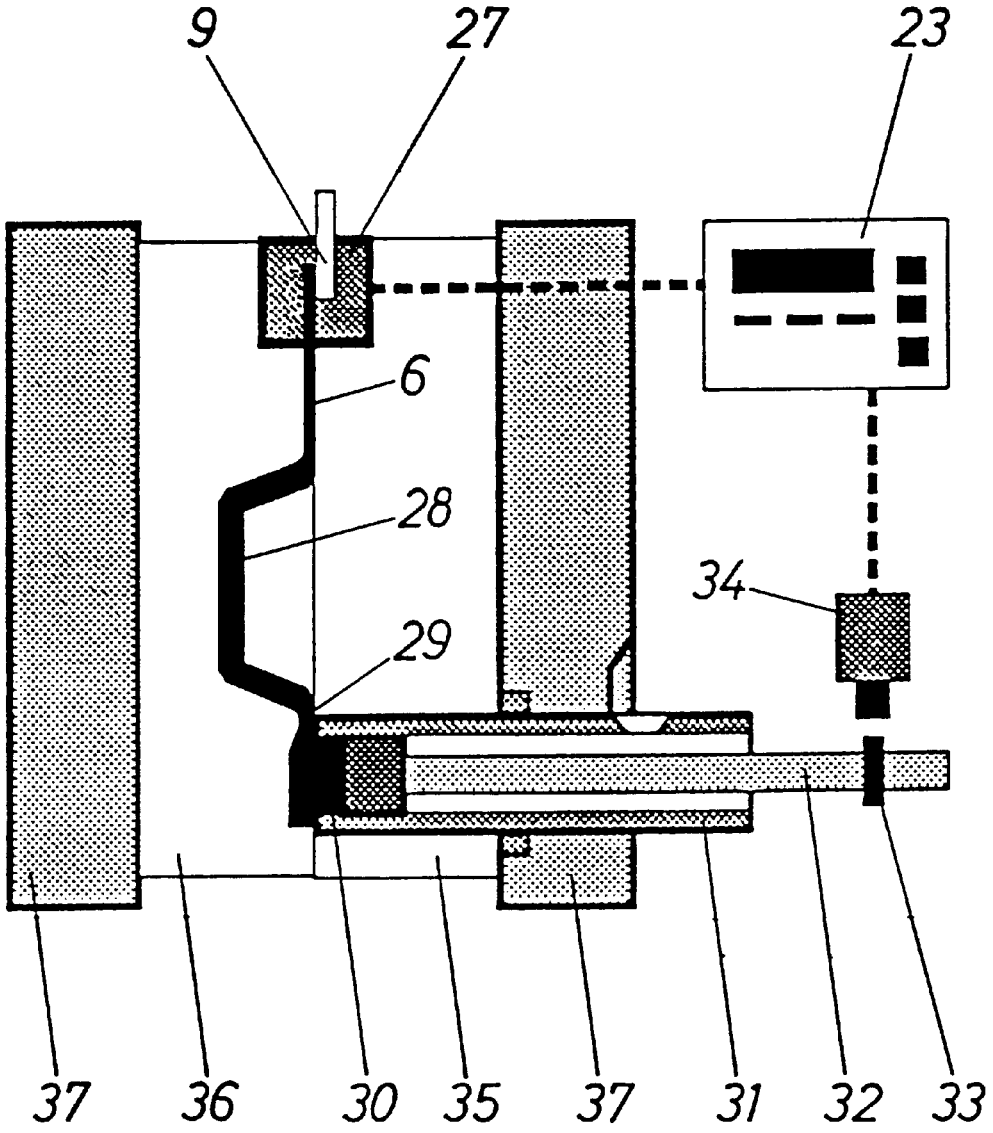
FIG. 2 shows the application of the device of FIG. 1 on a die-casting machine.

In FIG. 2, the application of the device of FIG. 1 on a die-casting machine is illustrated in a schematic manner. The venting valve device is schematically indicated by a unit 27 in which HR valve 21 is included while venting bore 9 and venting channel 6 are indicated as well as SPC control 23. SPC control 23 is connected to a "vacustop" signal transmitter 34 which in turn is operated by "vacustop" signal generator 33. The "vacustop" signal releaser 33 is located on the casting or injecting piston 32 which is guided in casting chamber 31. Further illustrated are fixed die-casting mold half 35 as well as movable die-casting mold half 36 and die-casting machine plates 37. Venting channel 6 is followed by mold cavity 28 and runner 29, which is connected to butt 30 after the filling operation. The SPC control may be one of the latest generation which uses program steps of approx. 30 milliseconds in the regular program flow and where the control command for the actuation of the HR valve can be singled out from the regular program flow so as to allow this particular control function to be executed in less than a millisecond. The control systems operate in this example with an operating voltage of 24 volts D.C. Furthermore, HR valve 21 is equipped with a digital logic.

The function of the venting valve device is as follows: At the beginning of the casting, pressure surface F1 of double-acting control piston 7 is subject to a pressure of max. 8 bars. The die-casting mold is open, and the last casting has been ejected by the pressure on F1. The die-casting mold is closed by the die-casting machine, the liquid metal is poured into casting chamber 31, and die-casting machine control 24 releases the cycle start for the injecting process. With a delay of e.g. 0.5 seconds, the evacuation of air and gases from the die-casting mold, the casting paths, and the casting chamber is started by die-casting machine control 24 via input A and output A', and vacuum valve 19 opens. The air and the gases in the die-casting mold are extracted by vacuum source 26 via venting channel 6, which connects the venting valve to mold cavity 28 of the die-casting mold, and conducted to a vacuum tank.

Simultaneously, second control valve 20 is started and opened by SPC control 23 directly or via input B and output B', the pressure at F2 rises to max. 8 bars, and the control piston is loaded. The injecting piston 32 is advanced at a high speed until it hits butt 30. Shortly before, the control signal is delivered by signal transmitter 34 via input C and output C' to HR valve 21. After receiving the control signal, the HR valve opens from 0 to 100% in less than two milliseconds and vents through outlet 21R. In the process, the pressure on first cylinder surface F1 collapses very quickly, and evacuation piston 8 is pushed into the closure bore of first venting bore 5 by the already existing pressure of max. 8 bar on cylinder surface F2 of control piston 7, thereby closing it. Control piston 7 acts via driving pins 11 which couple control piston 7, lever 15, and evacuation piston 8 to each other and which form a closing device together with hinge pin 12 and bearing block 16.

For a very short control stroke of control piston 7, a ratio of e.g. 1:3 has been chosen for lever 15. This ratio may be different, however, e.g. 1:2 to 1:5. After an adjustable time, HR valve 21 returns to the "normally open" position and restores the pressure on surface F1 in order to actuate, that is, open the venting valve and evacuation piston 8.

At the same time, control valves 19 and 20 also return to their basic positions, and the pressure at F2 falls to 0 bar, thus allowing to open evacuation piston 8. Mechanically, the limitation of the control stroke of the venting valve in the closing direction is established by the simultaneous impact of control piston and evacuation piston 8 on valve block 2. In this position, evacuation piston 8 evenly closes off venting bore 5 from venting channel 6 in order to prevent the entrance of liquid metal into venting bore 5 of valve block 1.

The control stroke limitation in the opening direction of evacuation piston 8 is determined by control piston 7 which is stopped by valve block 1. The precisely defined open position of the evacuation piston, i.e. of the entire venting valve, is ensured if equal and simultaneous pressures are acting on the differential surfaces F1 and F2 of control piston 7, which may also be called a differential piston. Pressure surface F1, i.e. on the opening side, is larger than pressure surface F2, e.g. according to a ratio of 2:1.

Depending on the injection piston speed, the obtained very short closing times of e.g. four milliseconds, as measured from output C' of SPC control 23, allow a fixed adjustment of the switching point for the control signal. The aim is to determine a fixed switching point which is independent from the injection piston speed, the size of the die-casting mold, or the die-casting machine. Piston speeds of up to 7 m/s are possible, resulting in a fixed switching point of vacustop signal generator 33 at e.g. 42 mm in front of the butt.

The control signal delivered to HR valve 21 may also be supplied by other sources, e.g. by die-casting machine control 24, by other metal sensors or pressure sensors, by acoustic detectors, heat detectors, or other electronic contacts. This is possible due to the flexibility of the applied SPC control 23.

The venting valve device has been described in relation with a high-speed die-casting installation, but it is also possible to use such a valve device for other casting installations, e.g. for low-pressure casting or injection molding.

What is claimed is:

1. A valve device comprising:

an evacuation valve that closes a channel in response to a signal from an electronic control circuit;

the evacuation valve being comprised of an evacuation piston actuated by a pneumatic control piston;

the pneumatic control piston being comprised of a double action differential piston having two pressure surfaces;

a first of said pressure surfaces being supplied with compressed air by a high response valve in order to open the evacuation piston; and a second of said pressure surfaces being supplied with compressed air by a second control valve in order to close the evacuation piston;

wherein the high response valve is comprised of a vent that abruptly reduces pressure that maintains the control piston in an open position.

2. The device of claim 1, wherein both said high response valve and said second control valve are controlled by a stored program control, the output of said stored program control being directly connected to the input of said high response valve.

3. The device of claim 2, wherein said stored program control is further connected to a vacuum valve which is disposed between a vacuum source and venting bores.

4. The device of claim 1, wherein said evacuation piston and said control piston are connected to each other by a lever.

5. The device of claim 4, wherein the connections between said lever and said control piston and said evacuation piston are established by driving pins provided on said lever, the ratio of the distance between the pivot of said lever and the point of actuation of the control piston and that between the pivot of said lever and the point of actuation of the evacuation piston being between 1:2 and 1:5.

6. The device of claim 5, wherein said ratio is 1:3.

7. The device of claim 1, wherein the ratio of the opening pressure surface to the closing pressure surface of said control piston is 2:1.

8. A venting valve device in a die casting machine comprising:

a die casting mold;

a stored program control for providing control signals for operation of the die casting machine;

an evacuation valve that opens and closes a channel in response to control signal from the stored program control;

the evacuation valve being comprised of an evacuation piston actuated by a pneumatic control piston;

the pneumatic control piston being comprised of a double action differential piston having two pressure surfaces;

a first of said pressure surfaces being supplied with compressed air by a high response valve in order to open the evacuation piston; and a second of said pressure surfaces being supplied with compressed air by a second control valve in order to close the evacuation piston, the high response valve being comprised of a vent that abruptly reduces pressure that maintains the control piston in an open position;

wherein air and residual gases in the die-casting mold are extracted through the channel while the second control valve is simultaneously opened in order to apply compressed air to said second pressure surface, whereby the closing movement of said control piston results from the ventilation of said high response valve so that the channel is closed by the extracting piston.

9. The venting valve device of claim 8, wherein the stored program control is directly connected to the high response valve, the stored program control receiving a closing signal and immediately transmitting the closing signal to said high response valve.

10. The venting valve device of claim 9, wherein the closing signal is provided from an injecting piston.

* * * * *